United States Patent [19]

von Hagen et al.

[11] Patent Number: 4,900,376

[45] Date of Patent: Feb. 13, 1990

[54] HARDENING A CYLINDRICAL HOLLOW OBJECT PREFERABLY MADE OF STEEL

[75] Inventors: Ingo von Hagen, Krefeld; Wilhelm Nickel, Muelheim; Christoph Prasser, Essen, all of Fed. Rep. of Germany

[73] Assignee: Mannesmann AG, Duesseldorf, Fed. Rep. of Germany

[21] Appl. No.: 210,077

[22] Filed: Jun. 22, 1988

[30] Foreign Application Priority Data

Jun. 26, 1987 [DE] Fed. Rep. of Germany ..... 3721665

[51] Int. Cl.[4] ..... C21D 9/08

[52] U.S. Cl. ..... 148/153; 148/146

[58] Field of Search ..... 148/153, 146

[56] References Cited

U.S. PATENT DOCUMENTS 3,231,434 1/1966 Seulen et al. ..... 148/153
3,944,446 3/1976 Bober ..... 148/146
4,421,575 12/1983 Murata et al. ..... 148/153

FOREIGN PATENT DOCUMENTS 3702784 6/1988 Fed. Rep. of Germany ..... 148/153
0113323 7/1983 Japan ..... 148/153

*Primary Examiner*—Upendra Roy
*Attorney, Agent, or Firm*—Ralf H. Siegemund

[57] ABSTRACT

A method for hardening cylindrical hollows made of steel, includes heating followed by cooling, under utilization of a water bath while the hollow rotates about its longitudinal axis, and is partially immersed in the bath, the axis being parallel to the surface of the cooling bath; this method is improved by providing a particular rotation for the hollow as long as the temperature of the hollow is above the martensitic starting temperature; and drastically increasing the speed of rotation such that a significantly higher speed obtains as the martensitic transition temperature is reached.

5 Claims, 1 Drawing Sheet

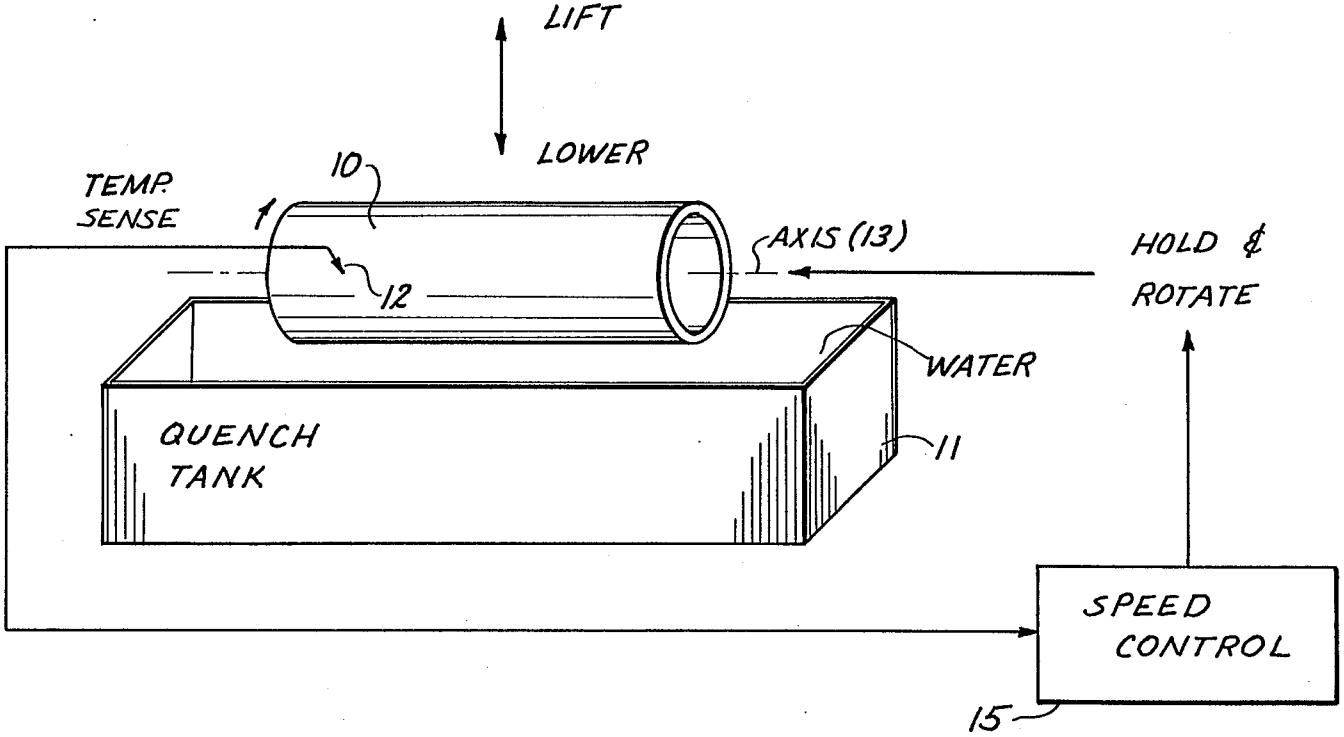
LIFT
LOWER
HOLD & ROTATE
AXIS (13)
WATER
11
10
12
TEMP. SENSE
QUENCH TANK
SPEED CONTROL
15

HARDENING A CYLINDRICAL HOLLOW OBJECT PREFERABLY MADE OF STEEL

BACKGROUND OF THE INVENTION

The present invention relates to hardening of cylindrical hollows such containers, pipes, tubing or the like, made of steel under utilization of a coolant bath, preferably a water bath, the hardening being carried out broadly in conjunction with and following a heat treatment. Generally, the hollow is deemed to have been heated, and is dipped into the coolant (quenching bath) in an orientation wherein the longitudinal axis runs parallel to the surface of the bath of the coolant. Only a portion of the hollow and its surface dips into the coolant at a time. The hollow is rotated about its axis in order to sequentially expose to the coolant all of the material of which the hollow is made.

A method of the type to which the invention pertains, and in which particularly heat removal is guaranteed as far as the entire container is concerned, is for example, discussed in the Russian journal *Metalovedenie i Termicheskaya Obrabotka Metalov,* number 9, 1985, pages 7 through 10, the title of paper being, in translation, *The Hardening of Bottles in a Water-Air Medium.*

Upon practising such a method, the number of revolutions of the container to be cooled is kept constant and adjusted such that a maximum rate of cooling obtains. As soon as the surface temperature drops to a particular pre-determined value which is usually in the vicinity of the beginning of the martensitic transition (for example 350 degrees C.), the container is lifted from the coolant bath, quenching is discontinuous and the container will now cool significantly slower in air taking at least 50 minutes, until room temperature is approached. It appears that the only way to reduce the over-all cooling time is by increasing the exposure time to the water bath and by shortening the cooling in air. That, however, is not an appropriate solution, because it was found that cracks and fissures occur in the material, or are at least most likely to occur, thus drastically increasing the failure rate. Obviously this is not a proper approach.

DESCRIPTION OF THE INVENTION

It is an object of the present invention to improve a method for hardening cylindrical hollows made of steel and as a phase of a thermal treatment under a utilization of a coolant such as water with only a portion of the hollow dipping into the water at a time, and to improve such a method so that the over-all time of cooling can still be reduced, whereby particularly towards the end of the cooling a uniform, gentle and careful cooling of the hollow is ensured, with emphasis on the fact that the ends of the hollows are thicker and these thicker ends are still also uniformly cooled.

In accordance with the preferred embodiment of the present invention, it is suggested to improve the method that is outlined in the object statement, by varying the number of rotations during the hardening by cooling, such that the rotational speed is drastically increased on reaching the starting temperature of martensitic transition (about 315 degrees C.), particularly when observed in the outer surface of the hollow. The numer of revolutions prior to obtaining the martensitic transitic range should be given by the relation $$N_1 = \frac{6685}{D}\left(1 + \frac{4H}{D}\right)$$

wherein D is the diameter of the mm, H the immersion depth also in mm and $N_1$ being given in revolutions per minute, moreover $N_1$ is to be at least 40 revolutions per minute. As the starting temperature of martensitic transition obtains, the rotational speed is at least doubled. The changeover can be a gradual one, or by means of a step. It was found, moreover, that it is advantageous to briefly lift the hollow from the container during the change in rotational speed, or somewhat ahead thereof, for a period of time amounting to 10 to 60 seconds.

DESCRIPTION OF THE DRAWINGS

While the specification concludes with claims particularly pointing out the distinctly claiming the subject matter which is regarded as the invention, it is believed that the invention, the objects and features of the invention, and further objects, features and advantages thereof will be better understood from the following description taken in connection with the accompanying drawings in which:

The FIGURE is a schematic view of equipment for practising the invention.

Proceeding to the detailed description of the drawings, the inventive method will be explained in conjunction with the heat treatment of a container 10. The container 10 is held at rotated in a coolant bath 11 (i.e. water). The number of revolutions per unit time is generally varied. Specifically, as the temperature is reached in which martensitic formation and transition occurs, or at least begins, the revolution is drastically increased. One can therefore can say that the cooling obtains in two different periods with different rates of cooling. The two ranges are separated by the martensitic starting temperature. During the first period of time, i.e. when the temperature is higher than the martensitic starting temperature, the container 10 is rapidly cooled simply in order to avoid the formation of undesired texture components and portions. As now the martensitic temperature is approached, this temperature is measured by a transducer 12. The speed of the container is now increased thereby beginning the second cooling phase.

It is an important aspect as compared with the prior art practice, that the liquid (water) cooling is not interrupted, but is continued. Hence, starting down from the martensitic starting temperature, the cooling is not dominantly carried out in air but still in water, but at a significantly lower rate. As the speed increases, the cooling rate is surprisingly diminished, the amount of heat outflow is reduced, but not as drastically as if all exposure to water had ceased. This amounts to a gentler way of cooling the container. This gentle cooling is beneficial because it avoids the formation of hardening cracks.

The increase of speed may be a gradual one by operation of control 15 as the martensitic temperature is approached, so that actually the martensitic temperature is not yet reached when the speed of rotation already increases. As now the martensitic temperature level is reached, the speed is definitely at a higher level. In other words, the gradual speed increase prior to reaching the martensitic starting temperature, assures that the cooling rate is not at its highest value by the time this particular critical temperature is actually reached.

One could, of course, delay the speed change until shortly before the martensitic transition temperature is reached, and then drastically increase the speed. However, this is a kind of gamble, because one really wants to be certain that the rotational speed is at a high rate, i.e. the cooling rate has been drastically reduced when that critical temperature is being reached. Particularly, also, the control in such a case is more critical as one should not introduce any delay in the speed change. In any event, the success of practicing the inventive method resides in the fact that cooling of the liquid continues, but at a reduced rate as soon as the martensitic temperature has been reached and the temperature continuous to drop below that value.

The invention depends on the following phenomenon. If a rotating, hot container dips into water, a vapor or steam skin or layer forms between the water and the steel surface. The higher the rotational speed, the easier is that steam layer disturbed or even destroyed, or at least its formation impeded. If now, as per the invention, the speed of rotatial of the container increases, the cycle time in which each indivicual surface element is in contact with the coolant and its given period of time is reduced, although of course the average contact time remains the same. But on the other hand, owing to the high rotation and adhesive forces, air is carried along and forced into the cooling medium. That air mingles, so to speak, with the steam and together in such a situation the cooling effect is reduced. One can determine optimum speeds in which very high cooling rates are realized which for a high speed a minimum of cooling or quenching speed obtains.

Since water is the most practical anc economic coolant, it is reasonable to determine practicing the invention ono the basis of the utilization of water as a coolant. Here, then, it was found that the revolution of the container prior to the reduction, should be given by the above formula with the priviso that the speed should be at least 40 revolutions per minute, D is the diameter of the hollow object in millemeters and H the immersion depth also in the millemeters. Now as the martensitic transition temperature is approached, the speed of rotation is increased by controller 15 and should amount to at least twice the value given by the formula above, even up to the five-fold value thereof. In some cases it may be of advantage during the change of speed, that means in effect, in between the two stationary cooling phases, to lift the rotating object 10 from the cooling tank 11 for about 10 to 60 seconds, so that the temperature of its outer surface is increased on account of heat. The migration from the deeper layers in the container walls. This, then, equalizes the temperature across the thickness of the wall, which in turn means that the temperature on the surface of the wall rises with certainly well above the martensitic starting temperature. It is for this reason that a gradual change-over in the cooling is advantageous. If now the quenching intensity is reduced for purposes of avoiding the formation of cracks, then owing to the lower temperatures, favorable temperatures obtain on the inside, and that in turn makes sure with one hundred percent certainty that martensitic temperatures are encountered everywhere at the reduced cooling rate.

In lieu of a container 10 having a closed front-end face, which impedes the flow of coolant into the interior of the container, tubing and pipes could be hardened instead, and here of course one could generate similar conditions simply by closing off one side or the other of the container end. On the other had hand, one should have to make sure that also on the other side uniform coolant conditions obtain.

The FIGURE shows a rotating steel container 10 with a diameter 224 mm being rotated about its longitudinal axis and cooled by immersion 80 deep into the water bath 11 while the longitudinal axis 13 of the container remained parallel to the surface level that bath. During a first step or stage of cooling (quenching), the rotation of the container $N_1$ amounted to 72 revolutions per minute. For this revolution and rate of rotation, and for the given diameter and immersion depth data, the speed by means of which progressive parts along the periphery, became immersed was sufficiently slow so that any air that was carried along did not significantly reduce the quenching. By means a pyrometer 12, the surface temperature was measured at an angle of about 90 degree displaced from the reemergence of the respective wall portion from the water bath. As soon as the martensitic starting temperature approached, the speed of rotation was increased to a value of approximately 150 revolutions per minute. Generally speaking, the first period of quenching lasted about 15 seconds, and now as the rotational speed was more than doubled, the quenching effect was drastically reduced, because at such a high speed a significant amount of air is carried along by the surface of the container as it rotates and immerses in the liquid to thereby reduce the cooling rate. Formation and cracks and fissures could be avoided simply by a reduction in the rate of cooling.

In another example, cooling was very good without the formation of crackes. Here, a container having a diameter of 339 mm was rotated at a speed of 48 revolutions/min. during the first phase of cooling. As the martensitic transition temperature was reached and detected in a manner similar described above, the speed was increased to 120 revolutions/minute and again the formation of cracks was readily avoided, but the whole cooling process lasted only 10 minutes, which is a significant improvement over an hour as per the prior art practice.

The invention is not limited to the embodiments described above; but all changes and modifications thereof, not constituting departures from the spirit and scope of the inventions, are intended to be included.

We claim:

1. In a method for hardening cylindrical hollow objects made of steel, including a cooling procedure that follows a heat treatment, under utilization of a stationary coolant bath, in a tank preferably a water bath, the hollow object rotating about its longitudinal axis while being partially immersed in the cooling bath, the axis being parallel to the surface of the cooling bath, the improvement comprising:

providing a particular rotation for the hollow object to be at least 40 revolutions per minute as long as an outer surface temperature of the hollow object is above the martensitic starting temperature; and drastically increasing the speed of rotation to at least twice the particular rotation such that a significantly higher speed obtains as the martensitic transition temperature is reached.

2. Method as in claim 1, wherein water is used as coolant and the speed of rotation being determined by the formula $$N = \frac{6685}{D}\left(1 + \frac{4H}{D}\right)$$

prior to the martensitic transition temperature, wherein D is the diameter of the hollow object in millimeter and H the immersion depth in millemeters; the speed, however, not exceeding 40 revolutions/minute and the speed of rotation at the martensitic temperature and below is at least twice that value.

3. Method as in claim 1, the speed being gradually changed.

4. Method as in claim 1, the speed being changed in step.

5. Method as in claim 1, including the step of lifting the hollow object for 10 to 60 seconds from the cooling bath immediately prior to, and/or during the rotational speed.

* * * * *